US006791025B2

(12) United States Patent
Devine

(10) Patent No.: US 6,791,025 B2
(45) Date of Patent: Sep. 14, 2004

(54) SUPPORTING INSULATEDLY SEPARATED CONDUCTORS

(75) Inventor: John D. Devine, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 10/208,133

(22) Filed: Jul. 30, 2002

(65) Prior Publication Data

US 2004/0020680 A1 Feb. 5, 2004

(51) Int. Cl.[7] ..... H01B 7/34
(52) U.S. Cl. ..... 174/36; 174/118
(58) Field of Search ..... 174/36, 74 R, 174/76, 77 R, 84 R, 102 R, 106 R, 110 R, 118, 113 R, 120 R, 122 G, 124 G

(56) References Cited

U.S. PATENT DOCUMENTS 4,408,088 A * 10/1983 Foote ..... 136/226
4,628,151 A * 12/1986 Cardas ..... 174/114 R
5,109,140 A * 4/1992 Nguyen ..... 174/36
5,266,744 A * 11/1993 Fitzmaurice ..... 174/103
5,548,082 A * 8/1996 Palmer ..... 174/34
5,831,210 A * 11/1998 Nugent ..... 174/27
6,362,418 B1 * 3/2002 Grandy et al. ..... 174/36
6,388,188 B1 * 5/2002 Harrison ..... 174/27
6,476,328 B2 * 11/2002 Agostinelli ..... 174/113 R
6,545,213 B1 * 4/2003 Gabriel ..... 174/36

* cited by examiner

*Primary Examiner*—William H. Mayo, III
(74) *Attorney, Agent, or Firm*—Fish & Richardson P.C.

(57) ABSTRACT

A support member includes a support member body, having a relatively stiff composite material having binding material and reinforcing material drawn through the binding material, and having a mounting end. At least two insulatedly separated conductors are within the composite material, each conductor having a first end exiting the support member body at a first portion and a second end exiting the support member body at a second portion separate from the first portion and drawn through reinforcing material with the binding material.

15 Claims, 3 Drawing Sheets

SUPPORTING INSULATEDLY SEPARATED CONDUCTORS

This invention relates to composite support structures. In a particular form, supporting insulatedly separated conductors are connected to terminals of a loudspeaker cantilevered from the support structure.

BACKGROUND OF THE INVENTION

Composite structures carrying a single conductor have been used for antennas. An important object of the invention is to provide improved methods and means for supporting insulatedly separated conductors.

Another object is to cantilever loudspeakers from a supporting structure carry conductors connected to the loudspeakers.

BRIEF SUMMARY OF THE INVENTION

According to the invention, a support member includes a support member body comprising a relatively stiff composite material comprising binding material and reinforcing material drawn through the binding material and having a mounting end. There are at least two insulatedly separated conductors within the composite material, each conductor having a first end exiting the support member body at a first portion and a second end exiting the support member body at a second portion separate from the first portion and drawn through the reinforcing material with the binding material. Typically, the first portion is located at the mounting end and the second portion is located at an end opposite the mounting end. The support member body is adapted to be cantilever-loaded when the mounting end is attached to a mounting surface. There may be a cantilevered load, such as a loudspeaker, attached to the support member body at an end opposite the mounting end. The support member body typically comprises a rod constructed and arranged to support the speaker with two of the conductors connected to the speaker at the end opposite the mounting end. The composite material typically comprises a pultruded composite material.

A method of using the support member includes attaching a load to a first end of the support member, and electrically connecting a first end of each conductor to the load. The method may further comprise attaching a mounting end of the support member to a mounting surface. The method may further comprise electrically connecting a second end of each electrical conductor to a signal source and transmitting an electrical signal from the signal source to the load through the conductors.

A method of making the support member may comprise combining a reinforcing material and two conductors in a binding material to generate a conductive support member body, shaping the support member body, and curing the support member body, whereby each conductor has a first end exiting the support member body at a first portion and a second end exiting the support body at a second portion separate from the first portion. The method may further comprise drawing the reinforcing material and two conductors through the binding material to generate a pultruded support member body.

The apparatus may further comprise a source of an audioelectrical signal coupled to the speaker through the conductors, and a television forward of the speaker coacting therewith to form a home theater demonstration system with surround sound.

Other features, objects, and advantages of the invention will be apparent from the following description when read in connection with the accompanying drawing in which:

BRIEF DESCRIPTION OF THE SEVERAL VIEWS OF THE DRAWING

Like reference symbols indicate like elements throughout the drawing.

DETAILED DESCRIPTION

Figure 1:
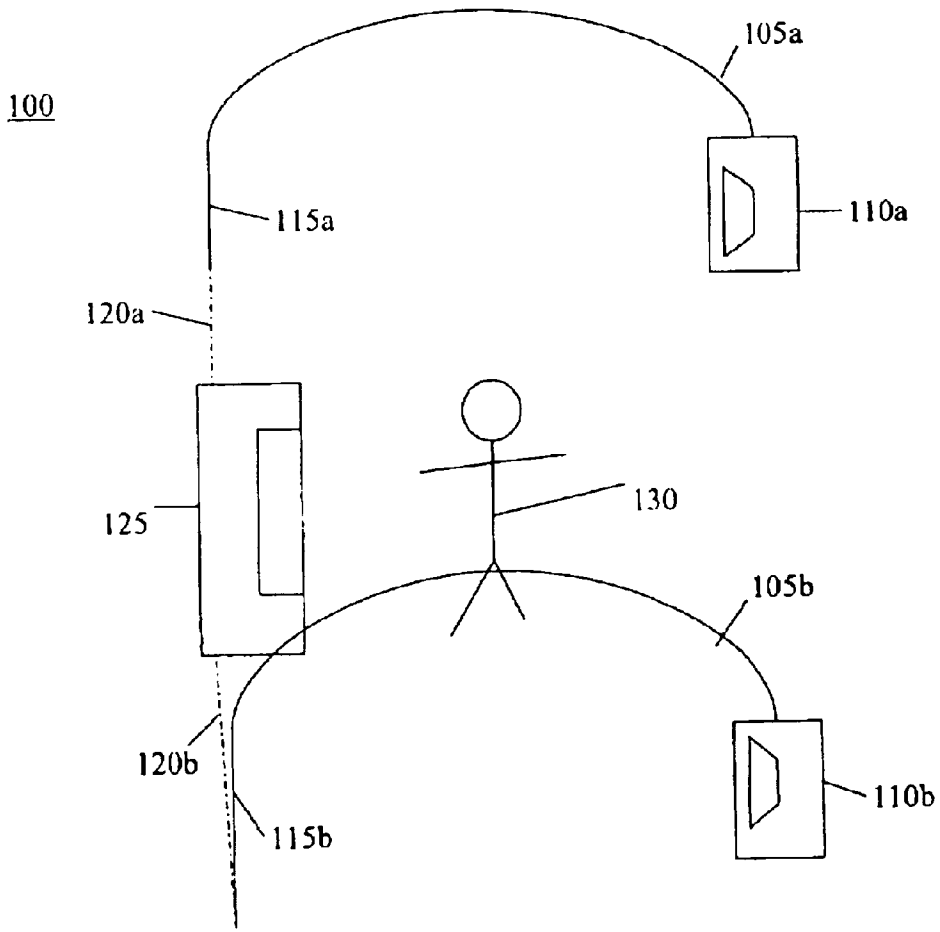
FIG. 1 is a diagrammatic representation of a system according to the invention.

FIG. 1 illustrates a system 100 according to the invention that includes support members 105*a* and 105*b*. The system 100 also includes speaker elements 110*a* and 110*b*, mounting structures 115*a* and 115*b*, speaker insulatedly separated conductive pairs 120*a* and 120*b* especially useful for supporting surround speakers in a home theater system, convenient for demonstrating to one or more consumers 130, and an audio signal source and television 125. The cantilevered support members 105*a* and 105*b* support surround speakers 110*a* and 110*b* respectively and enclose conductive pairs 120*a* and 120*b* respectively. The mounting structures 115*a* and 115*b* can be a wall, a stand and the like.

Speakers 110*a* and 110*b* are typically surround speakers in a surround-sound system. Further, the audio signal source and television 125 can include, for example, a large screen television and a DVD player. In demonstrating the home theater with surround-sound to a consumer 130, surround speakers 110*a* and 110*b* are six to seven feet away from the audio signal source and television 125. The support members 105*a* and 105*b* are longer than the six to seven feet to create the conductive support members 105*a* and 105*b* where, in one embodiment, each has a slight arch dependent on its stiffness (e.g., modulus of elasticity).

Figure 2:
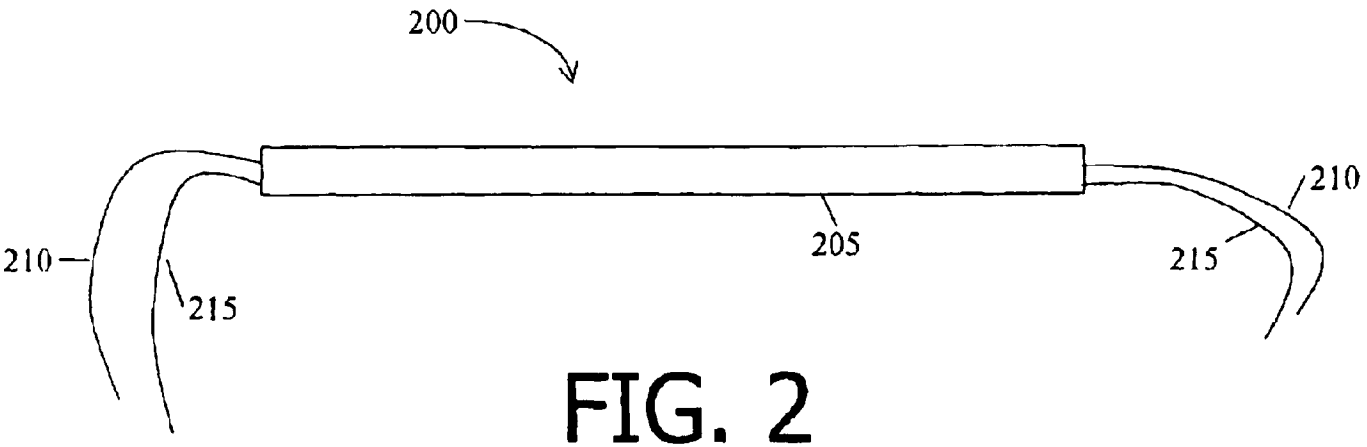
FIG. 2 is a view of an illustrative embodiment of enclosing and supporting a pair of insulatedly separated conductor support member in accordance with the invention.

FIG. 2 illustrates an embodiment 200 of a support member 105 in more detail. The conductive support member 105 of this embodiment 200 includes a support member body 205 enclosing insulatedly separated electrical conductors 210 and 215. The electrical conductors 210 and 215 exit at each end of the support member body 205, allowing electrical connection at each end. The electrical conductors 210 and 215 comprise a metallic material (e.g., copper, aluminum and the like) and can be solid or stranded. Between the exit points, the electrical conductors 210 and 215 are included within the support member body 205. The support body 205 comprises a composite material, described in more detail below.

Figure 3:
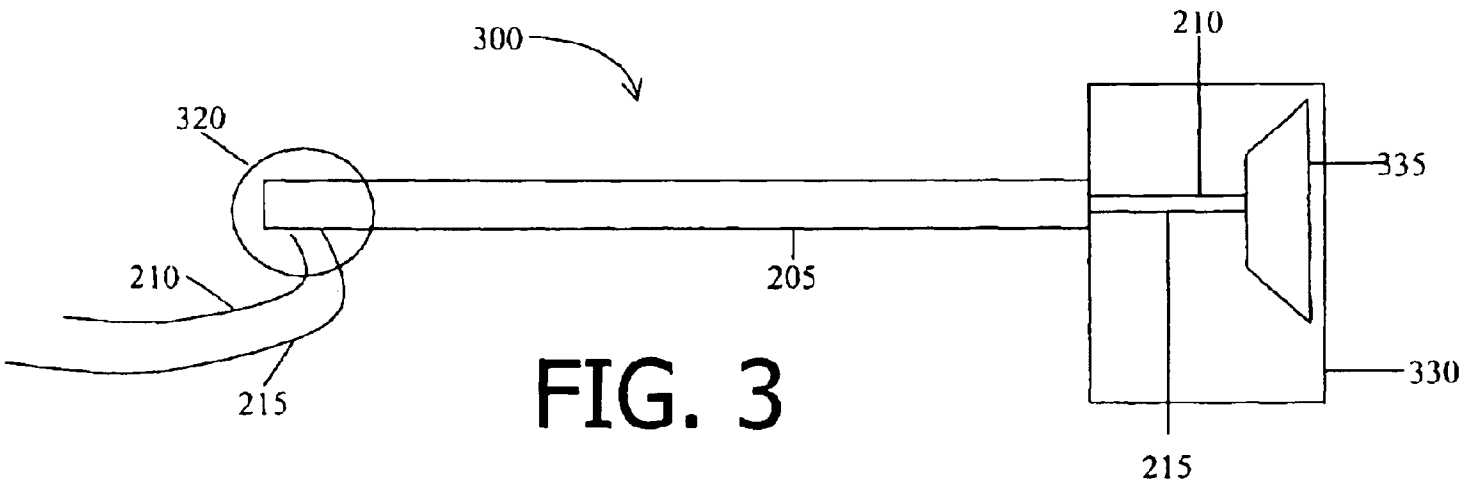
FIG. 3 is a pictorial representation of another illustrative embodiment of a system with conductive support member enclosing a pair of insulatedly separated conductors connected to a loudspeaker supported thereby in accordance with the invention.

FIG. 3 illustrates another embodiment 300 of a conductive support member 105 in more detail. The conductive support member 105 of this embodiment 300 includes the support member body 205, insulatedly separated electrical conductors 210 and 215 and a mounting end 320. In this embodiment 300, a speaker 330 attaches at one end of the support member body 205 opposite the mounting end 320.

The electrical conductors 210 and 215 exit at each end of the support member body 205, allowing electrical connection at each end. In this embodiment 300, the electrical conductors 210 and 215 exit out the side of the support member body 205 at the mounting end 320 to allow the mounting end 320 to position flush against a mounting surface. Between the exit points, the electrical conductors 210 and 215 are included within the support member body 205.

The speaker 330 includes a driver element 335. The electrical conductors 210 and 215 are electrically connected to the driver element 335. This allows an audio source (e.g., 125 of FIG. 1) electrically connected to the conductors 210 and 215 at the mounting end 320 of the support member body 205 to transmit an electric signal along the two conductors 210 and 215 to drive the driver element 335 at the other end of the support member body 205. In this embodiment 300, the dimensions of the support member body 205 are based on several factors. These factors include, for example, the weight of the speaker 330, the desired distance of the speaker 330 from the mounting end 320 when cantilevered, the amount of desired arch when cantilevered, the composite material used to create the support member body 205 and the like.

Figure 4:
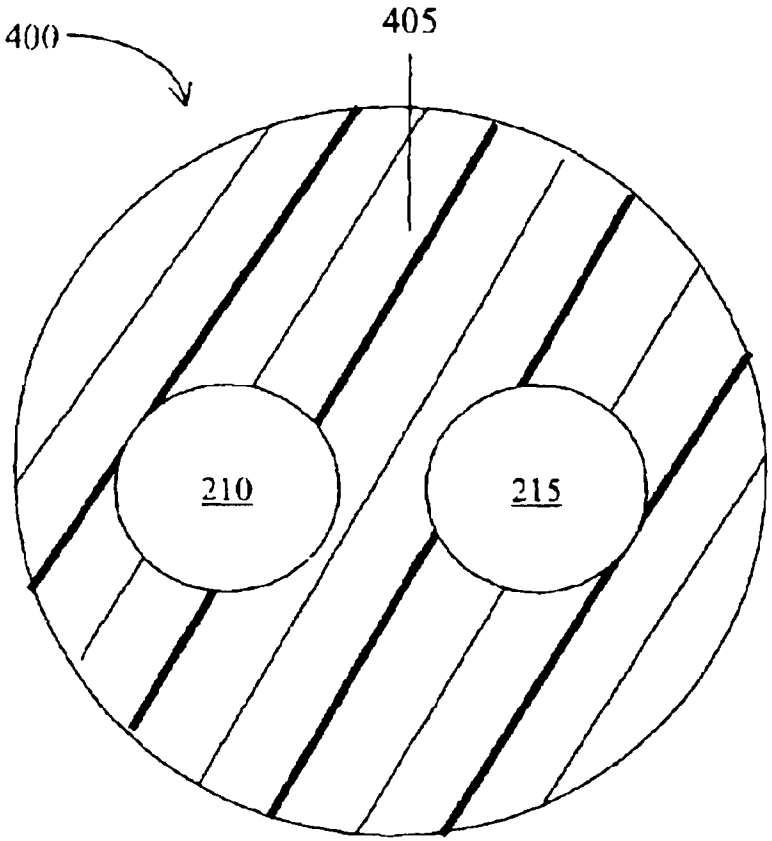
FIG. 4 is a view of a cross section of a support member enclosing a pair of insulatedly separated conductors in accordance with the invention.

FIG. 4 illustrates an embodiment of a circular cross section 400 of a support member body 205 in more detail. The cross section 400 includes a composite material 405 and electrical conductors 210 and 215. The electrical conductors 210 and 215 can vary in size depending on the electrical signal they carry and the desired size of the cross section 400. In one embodiment, for example for use with a speaker (e.g., 330 of FIG. 3), the size of the electrical conductors 210 and 215 is 16 gauge.

The composite material 405 comprises a reinforced plastic. The reinforced plastic comprises a portion that is a binding material (e.g., polymer matrix) and a portion that is a reinforcing material (e.g., reinforcing fiber), providing structural strength to the binding material. Typically, in a composite material, the reinforcing material (e.g., fibers) molecularly bonds to the binding material. The binding materials can comprise, for example, polyester resins, vinyl ester resins, epoxy resins, phenolic resins, polyurethane resins, silicone resins and the like. The reinforcing materials can include, for example, glass, carbon fibers, aramid, polyester fibers and the like.

In one embodiment, a method of manufacture to generate the support member body 205 is the pultrusion process. Pultrusion is a continuous process of drawing the reinforcing material (e.g., numerous glass monofilaments) through the binding material (e.g., a resin bath) and into a curing and shaping die. The process of manufacturing the support member body 205 also draws the electrical conductors 210 and 215 through the binding material along with the reinforcing material so that they are cured and shaped to become an integral part of the support member body 205. The forms of reinforcement can include, for example, rovings (tows, for carbon fiber), stitched rovings in different orientations, woven rovings, bulk rovings and the like.

The stiffness of the conductive support member 105 can depend on the dimensions of the support member body 205, the types of binding materials and reinforcing materials used and the ratio of the reinforcing material to the binding material. For example, increasing the width (e.g., diameter of a rod) of the support member body 205 results in a stiffer support member 105. For binding materials, polyester resin is less stiff than vinyl ester resin, which is less stiff than epoxy resin. Similarly, B-glass is less stiff than S-glass, which is less stiff than carbon. Increasing the ratio of reinforcing material to the binding material also leads to an increased stiffness. For example, a conductive support member 105 designed as a rod (i.e., circular cross section) to position a speaker 110 weighing one kilogram at a distance of six to seven feet is 12 feet or 3.65 meters long and has a diameter of 0.375 inches or 9.5 mm. These dimensions correspond to a conductive support member 105 comprising continuous filament E-glass, two 16 gauge insulated stranded copper wires and catalyzed polyester resin.

Figure 5:
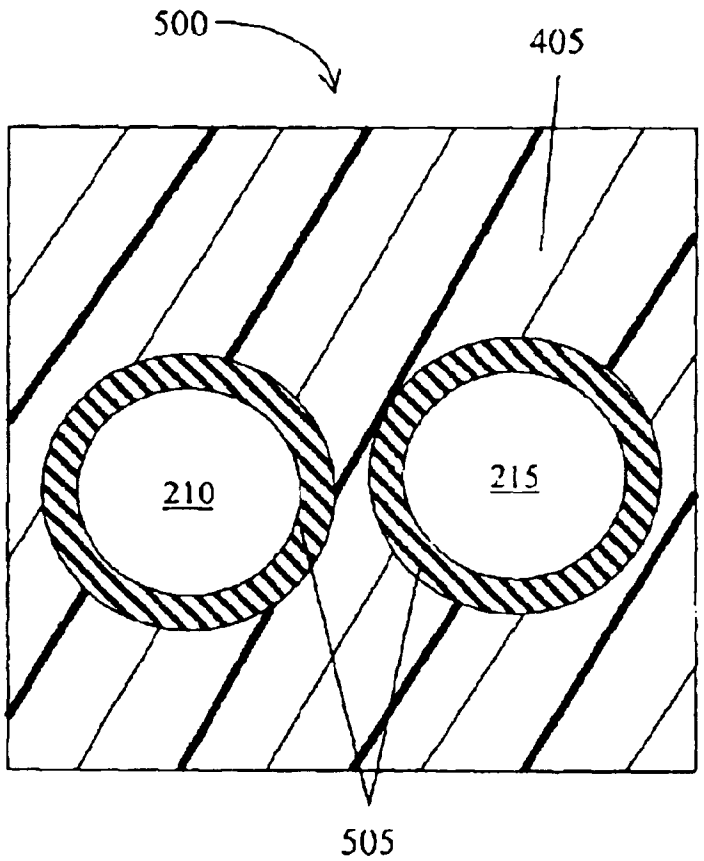
FIG. 5 is a view of a cross section of a support member enclosing a pair of insulatedly separated conductors in accordance with the invention.

FIG. 5 illustrates an embodiment of a square cross section 500 of a support member body 205 in more detail. The cross section 500 includes the composite material 405, electrical conductors 210 and 215 and wire insulation 505. The wire insulation 505 comprises any known wire insulation. The composite material 405 can be electrically insulating. The embodiment of cross section 500 uses additional electrical insulation 505 around the electrical conductors 210 and 215, however, so that the portion of the electrical conductors 210 and 215, including the wire insulation 505, that exits and exists outside of the support member body 205 (FIG. 2) can be used more safely.

A number of embodiments of the invention have been described. Nevertheless, it will be understood that various modifications may be made without departing from the spirit and scope of the invention. For example, in addition to a circle and a square, the cross-sectional shape of the support member body can be an oval, a polygon and the like. Also, manufacture of the conductive support member can include materials and processes equivalent to those mentioned. Accordingly, other embodiments are within the scope of the following claims.

What is claimed is:

1. A support member comprising:

a support member body comprising a relatively stiff composite material comprising binding material and reinforcing material drawn through the binding material having a mounting end; and at least two insulatedly separated conductors within the composite material, each conductor having a first end exiting the support member body at a first portion and a second end exiting the support member body at a second portion separate from the first portion and drawn through reinforcing material with the binding material.

2. The member of claim 1 wherein the first portion is located at the mounting end and the second portion is located at an end opposite the mounting end.

3. The member of claim 1 wherein the support member body is adapted to be cantilever-loaded when the mounting end is attached to a mounting surface.

4. The member of claim 3 further comprising a cantilevered load attached to the support member body at an end opposite the mounting end.

5. The member of claim 4 wherein the load comprises a speaker.

6. The member of claim 1 wherein the composite material comprises a pultruded composite material.

7. The member of claim 1 wherein the binding material comprises polyester resins, vinyl ester resins, epoxy resins, phenolic resins, polyurethane resins or silicone resins.

8. The member of claim 1 wherein the reinforcing material comprises glass, carbon fibers, aramid or polyester fibers.

9. A method of using the support member of claim 1 comprising:

attaching a load to a first end of the support member; and electrically connecting a first end of each conductor to the load.

10. The method of claim 9 further comprising attaching a mounting end of the support member to a mounting surface, the mounting end disposed opposite the first end.

11. The method of claim 10 further comprising:

electrically connecting a second end of each electrical conductor to a signal source; and transmitting an electrical signal from the signal source to the load through the conductors.

12. A method of making the support member of claim 1 comprising:

combining a reinforcing material and two conductors in a binding material to generate a conductive support member body, shaping the support member body; and curing the support member body, wherein each conductor has a first end exiting the support member body at a first portion and a second end exiting the support member body at a second portion separate from the first portion.

13. The method of claim 12 wherein combining further comprises drawing the reinforcing material and two metallic conductors through the binding material to generate a pultruded support member body.

14. A support member comprising:

a support member body comprising a relatively stiff composite material comprising binding material and reinforcing material drawn through the binding material having a mounting end, the support member body being adapted to be cantilever-loaded when the mounting end is attached to a mounting surface;

at least two insulatedly separated conductors within the composite material, each conductor having a first end exiting the support member body at a first portion and a second end exiting the support member body at a second portion separate from the first portion and drawn through reinforcing material with the binding material; and a cantilevered load attached to the support member body at an end opposite the mounting end, the load comprising a speaker, wherein the support member body comprises a rod, constructed and arranged to support the speaker with two of said conductors connected to the speaker at the end opposite the mounting end.

15. An apparatus in accordance with claim 14 and further comprising a source of an audio electrical signal coupled to said speaker through said conductors, and a television forward of said speaker coacting therewith to form a home theater demonstration system with surround sound.

* * * * *